US007744476B2

(12) United States Patent
Knijpstra

(10) Patent No.: US 7,744,476 B2
(45) Date of Patent: Jun. 29, 2010

(54) FAIRGROUND ATTRACTION HAVING A HEIGHTWISE MOVABLE PEOPLE CARRIER

(75) Inventor: Hette Knijpstra, Terband (NL)

(73) Assignee: K.I.G. Heerenveen B.V., Terband (NL)

( * ) Notice: Subject to any disclaimer, the term of this patent is extended or adjusted under 35 U.S.C. 154(b) by 54 days.

(21) Appl. No.: 11/667,657

(22) PCT Filed: Nov. 15, 2005

(86) PCT No.: PCT/NL2005/000796

§ 371 (c)(1),
(2), (4) Date: Nov. 28, 2007

(87) PCT Pub. No.: WO2006/052132

PCT Pub. Date: May 18, 2006

(65) Prior Publication Data

US 2008/0200270 A1 Aug. 21, 2008

(30) Foreign Application Priority Data

Nov. 15, 2004 (NL) ..... 1027510

(51) Int. Cl.
*A63G 1/08* (2006.01)
*A63G 1/00* (2006.01)

(52) U.S. Cl. ..... 472/31; 472/1; 472/46

(58) Field of Classification Search ..... 472/3, 472/31–33, 44–47, 133
See application file for complete search history.

(56) References Cited

U.S. PATENT DOCUMENTS 3,243,184 A * 3/1966 Robinson et al. ..... 472/1
3,707,282 A * 12/1972 Robinson ..... 472/1
4,007,926 A * 2/1977 Ottaway ..... 472/29
6,620,051 B2 * 9/2003 Kroon et al. ..... 472/31

FOREIGN PATENT DOCUMENTS

DE 296 06 585 U1 8/1996
GB 2 337 944 A 12/1999

* cited by examiner

*Primary Examiner*—Kien T Nguyen
(74) *Attorney, Agent, or Firm*—Harness, Dickey & Pierce, P.L.C.

(57) ABSTRACT

An embodiment of the present invention relates to a fairground attraction, including an arm which is mounted for rotation about a shaft in a bearing arranged in the top of the frame, on an end of which arm at least one people carrier is suspended, a device for rotatingly driving the arm, and a device for displacing the at least one people carrier in height direction in a rest position of the arm, which displacing device is arranged between the top supporting the bearing and the remaining part of the frame. In one embodiment of the present invention, the top can be pivotable relative to the remaining frame part, for instance about a lying axis which lies transversely of the rotation axis of the arm, and the displacing device can include a drive for causing pivoting of the top. The fairground attraction can further be provided with a device for blocking the displacing device during operation of the fairground attraction.

16 Claims, 2 Drawing Sheets

FAIRGROUND ATTRACTION HAVING A HEIGHTWISE MOVABLE PEOPLE CARRIER

Figure 1:
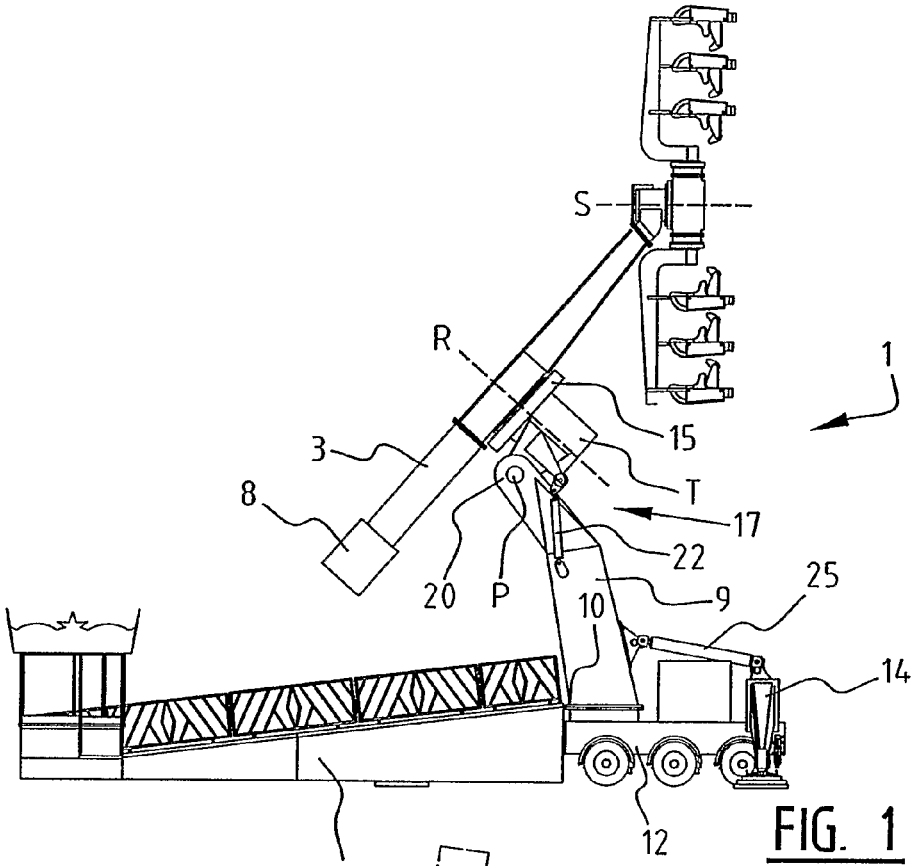

The invention relates to a fairground attraction, comprising an upright frame, at least one arm which is mounted for rotation about a shaft in a bearing arranged in the top of the frame, wherein at least one people carrier is suspended on an end of the least one arm, means for rotatingly driving the at least one arm, and a device for displacing the at least one people carrier in height direction in a rest position of the at least one arm. Such a fairground attraction is described in the non-prepublished Netherlands patent application 1024884 of applicant.

A generally occurring problem in fairground attractions is that the public is always demanding new exciting sensations. The attractions are developed for this purpose such that the people carriers can execute increasingly larger and wilder movements. In order to ensure the safety of the passengers the free space inside the profile of the construction available for this purpose must also become increasingly larger. This however results to an increasing extent in problems relating to boarding and disembarkation of the passengers.

Heretofore use has been made for this purpose in many attractions of a platform displaceable in height direction. As the free space required for the movements of the people carrier(s) increases, the distance which the platform must bridge between the position in which passengers can step on and off and the position occupied during operation of the fairground attraction also increases. Increasingly larger and heavier drive systems are therefore necessary to displace the platform in height direction. This is a particular drawback for fairground attractions which it must be possible to construct, dismantle and transport in simple manner. It must further be taken into account that the average duration of a ride in a fairground attraction amounts to only a few minutes, so that boarding and disembarkation is a very regularly recurring event which therefore requires a relatively large amount of energy.

In the above stated Netherlands patent application 1024884 a fairground attraction is therefore proposed wherein the rotating arm is suspended from the frame via an eccentric rotation coupling. When the attraction is at rest and visitors must board and disembark, the arm is moved slightly downward by rotating the eccentric coupling, whereby the boarding height above the platform is reduced. By displacing the arm with the people carrier(s) in height direction use can be made for boarding and disembarkation of a fixed platform which can be of simple and light construction. The fairground attraction can hereby be constructed and dismantled more rapidly, while less space, and therefore possibly fewer trucks, are required for transport thereof. In addition, the energy consumption of the fairground attraction is lower through not having to displace the platform.

Applicant further markets a fairground attraction under the name "TopScan" wherein use is likewise made of the principle of height adjustment of the people carriers in combination with a fixed platform. In this known attraction the frame is mounted pivotally on a base on its underside. The frame together with the arm and the people carriers can thus be displaced by means of large hydraulic jacks, which have their own drive, between a rest position, in which the arms with people carriers is suspended just above the platform, and an operating position in which the arm with the people carriers can perform its movements at greater height above the platform. This attraction has the drawback that a high-powered drive is required for the up and downward movement of the frame including the arm and people carriers. In practice a drive is used for this purpose with a power of 50 kW, while no more than 150 kW is needed to perform the movements of the arm and the people carriers, thus the actual driving of the attraction. Boarding and disembarkation here therefore require a disproportionally large amount of energy.

The invention now has for its object to provide a fairground attraction of the type described in the preamble, wherein the eccentric rotation coupling is replaced by another mechanism for the height adjustment. According to the invention this is achieved in such an attraction in that the displacing device is arranged between the top supporting the bearing and the remaining part of the frame. Only the top with the bearing, the armed and the people carrier(s) thus have to be displaced, whereby compared to the "TopScan" less energy is required for the height adjustment during boarding and disembarkation.

A structurally simple and robust fairground attraction is obtained when the top is pivotable relative to the remaining frame part and the displacing device comprises a drive for causing pivoting of the top.

In order to enable up and downward movement of the people carrier(s) straight in front of the frame, in a preferred embodiment of the fairground attraction according to the invention the top is pivotable about a lying axis which lies substantially transversely of the rotation axis of the arm.

A displacing device which is readily integrated into the fairground attraction is obtained when the drive comprises at least one hydraulic jack, one end of which is connected to the top and the other end to the remaining frame part. Because hydraulic drives are also applied elsewhere in the attraction, the production and maintenance of the fairground attraction is thus simplified.

For a uniform distribution of the loads in the construction thereof, the fairground attraction is preferably provided with two hydraulic jacks arranged on either side of the bearing.

In order to prevent displacement of the people carrier(s) relative to the arm(s) during the rotation thereof —whereby the people carrier(s) could after all come into contact with fixed parts of the frame or the ground—the fairground attraction is preferably provided with means for blocking the displacing device during operation of the fairground attraction.

In order to simplify as much as possible the connections and couplings between the mutually movable parts of the attraction, the drive means of the arm are preferably accommodated in the pivotable top.

Figure 2:
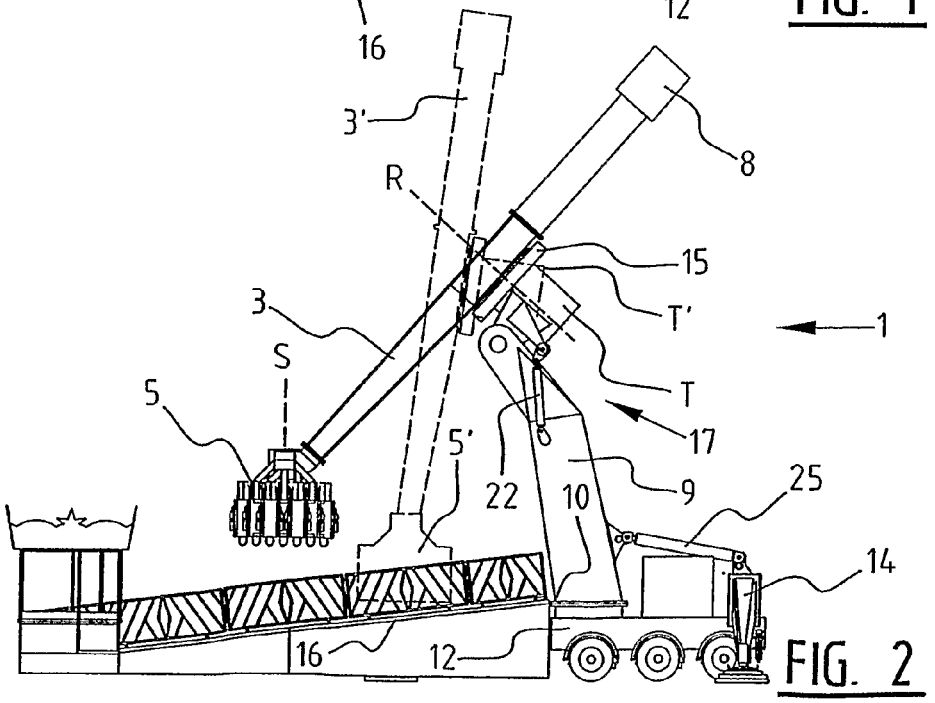
Figure 3:
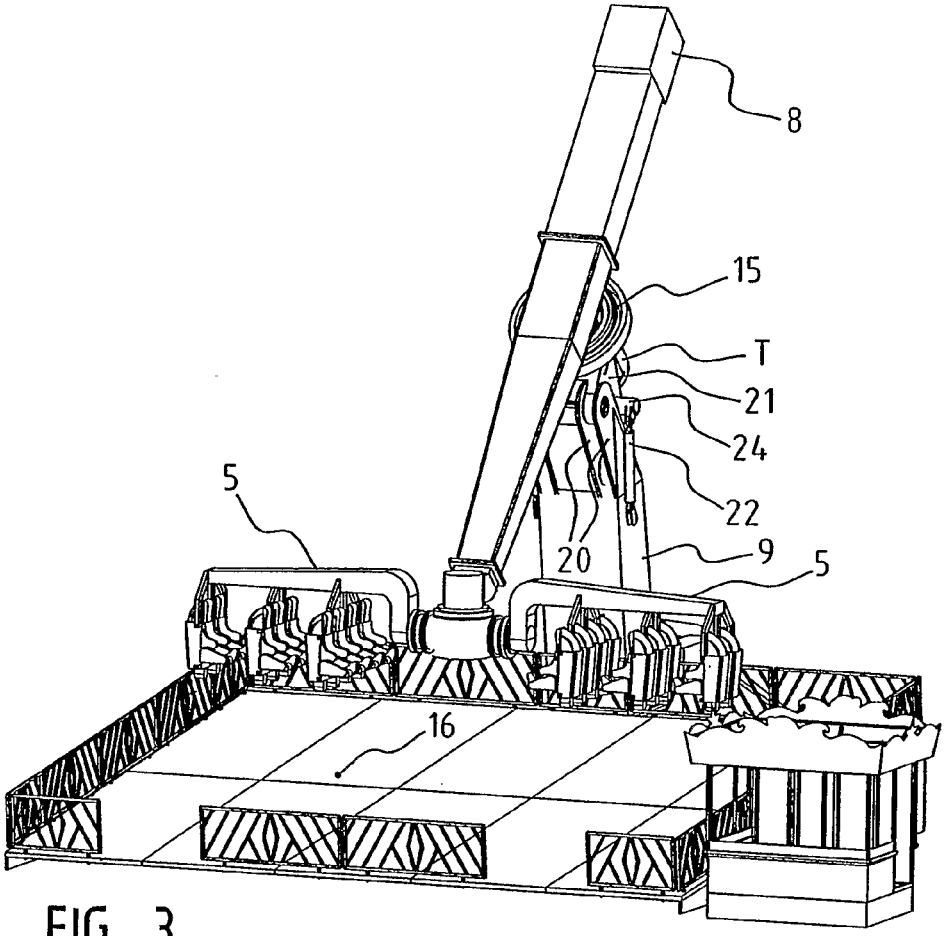
Figure 4:
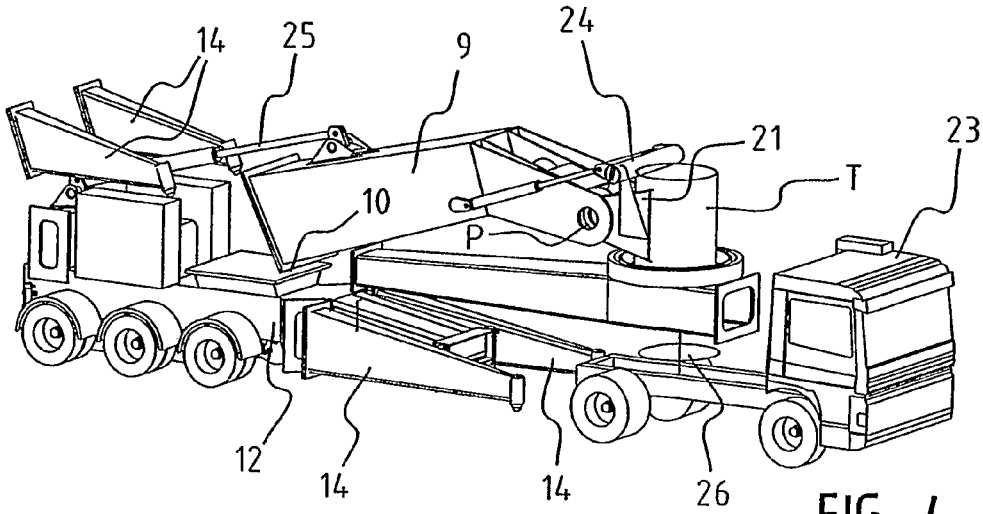

The invention will now be elucidated on the basis of an exemplary embodiment, wherein reference is made to the accompanying drawing, in which:

FIG. 1 is a side view of a fairground attraction according to the invention during operation, FIG. 2 is a side view of the fairground attraction of FIG. 1 with the arm in its rest position, wherein the boarding and disembarking position is shown in broken lines, FIG. 3 shows a perspective view of the attraction in this rest position, and FIG. 4 is a perspective view of the fairground attraction in collapsed position for transport purposes.

A fairground attraction 1 (FIG. 1) comprises a frame 2 and an arm 3 which is mounted for rotation about an axis R in a bearing 15 in the top T of frame 2. The axis of rotation R encloses an angle of 45° with the horizon. Present for the purpose of causing rotation of arm 3 are drive means (not shown here), for instance in the form of an electric motor or hydraulic motor accommodated in the top T of frame 2. Arm 3 is provided at one end 4 with two people carriers 5, while a counterweight 8 is arranged on the opposite end of arm 3. In the shown embodiment people carriers 5 are rotatable relative to arm 3 on the their own longitudinal axis S and on an oblique axis S which encloses an angle of 45° with arm 3. Each people carrier 5 is formed here by a bracket 6 from which a number of seats 7 are suspended.

Frame 2 is formed in the shown embodiment by a single mast 9 which is mounted with one end on a plinth 11 for pivoting about a shaft 10. This plinth 11 is in turn mounted on an undercarriage 12 with wheels 13 so that the fairground attraction 1 is mobile and can be coupled as trailer behind a tractive vehicle 23 (FIG. 4). In order to stabilize the attraction 1 the undercarriage 12 is provided with movable or releasable jacking arms 14. In order to move mast 9 from its collapsed transporting position to its upright operating position the attraction 1 is provided with one or more hydraulic jacks 25.

In order to allow passengers to step on and off, a platform 16 is placed in front of undercarriage 12. In respect of the possible movements of people carriers 5, the dimensions of arm 3 and of mast 9 are chosen such that under all conditions there is a safe, and therefore relatively large distance between people carriers 5 on the one hand and the fixed parts of attraction 1 and the ground G on the other. This has the consequence that when arm 3 is occupying its rest position (FIG. 2) the distance H between people carriers 5 and platform 16 is too large to allow passengers to board and disembark. According to the invention fairground attraction 1 therefore has a device 17 for displacing people carriers 5 in height direction when arm 3 is situated in the rest position. People carriers 5 can be lowered through a determined distance from the position shown in FIG. 2 by this displacing device 17, whereby seats 7 are situated at a normal boarding and disembarking height h above platform 16 (shown in broken lines in FIG. 2). Owing to this provision the platform 16 itself does not therefore have to be displaceable in height direction, whereby the construction of the attraction is greatly simplified.

In the shown embodiment displacing device 17 is formed by a pivot connection 18 between the top T supporting the bearing 15 and the remaining part of mast 9, in combination with a drive 19 for causing pivoting of top T. This pivot connection 18 comprises a pair of ears 20 on the upper side of the remaining part of mast 9 which engage round spacers 21 of the top T. Both ears 20 and spacers 21 have openings in register through which extends a pivot shaft P. Drive 19 comprises two hydraulic jacks 22 which are arranged on either side of mast 9 and which are fed by a pump of relatively limited power, for instance in the order of 15 kW. These jacks 22 are each connected with an end to the remaining mast part 9, while their other end is fixed to a cross beam 24 extending behind spacers 21 of top T. By extending jacks 22 the top T is tilted in the direction of platform 16, whereby arm 3 with people carriers 5 descends to platform 16 and the passengers can easily step on and off.

Means (not shown here) can further be present for blocking displacing device 17 during operation of fairground attraction 1. These blocking means 21 could comprise for instance a movable locking pin which would rigidly connect the top T and the rest of mast 9 to each other.

As stated, displacing device 17 also enables compact folding together of attraction 1 in order to allow transport thereof by road. For this purpose drive 19 is activated for so long that jacks 22 are fully extended and top T pivots so far about shaft P that arm 3 comes to lie along mast 9. A very compact whole is obtained by tilting mast 9 itself forward on its pivot shaft 10 using jacks 25. A coupling pin can herein be fixed onto arm 3 in the line of rotation axis R, whereby the undercarriage can be placed onto rotating plate 26 of tractive vehicle 23.

Although the invention has been elucidated above on the basis of an embodiment, it will be apparent that it is not limited thereto. A fixed attraction could thus also be provided with the described and shown displacing device. In addition, the displacing device could also be embodied differently, for instance with a pivot axis in a different orientation, and different driving. The scope of the invention is therefore defined solely by the following claims.

The invention claimed is:

1. Fairground attraction, comprising:

an upright frame;

at least one arm which is mounted for rotation perpendicularly about a longitudinal axis of the at least one arm in a bearing arranged in a top of the frame, said top of the frame being pivotable relative to a remaining part of the frame;

at least one people carrier suspended on an end of the least one arm that is spaced from the rotation axis;

means for rotatingly driving the at least one arm;

a displacing device arranged between the top of the frame supporting the bearing and the remaining part of the frame, which displacing device comprises a drive for causing pivoting of the top of the frame; and means for blocking the displacing device during operation of the fairground attraction, wherein the displacing device is arranged to displace the at least one people carrier in height direction in a rest position of the at least one arm.

2. Fairground attraction as claimed in claim 1, wherein the blocking means comprise a movable locking pin which rigidly connects the top of the frame and the remaining part of the frame to each other.

3. Fairground attraction as claimed in claim 1 wherein the top of the frame is pivotable about a lying axis which lies substantially transversely of the rotation axis of the arm.

4. Fairground attraction as claimed in claim 1, wherein the drive comprises at least one hydraulic jack, one end of which is connected to the top of the frame and the other end to the remaining part of the frame.

5. Fairground attraction as claimed in claim 4, further comprising two hydraulic jacks arranged on either side of the bearing.

6. Fairground attraction as claimed in claim 4, wherein when the at least one hydraulic jack is fully extended the top of the frame pivots so that the at least one arm comes to lie along the remaining part of the frame.

7. Fairground attraction as claimed in claim 1, wherein the drive means of the arm are accommodated in the pivotable top of the frame.

8. Fairground attraction as claimed in claim 1, wherein during operation of the fairground attraction the axis of rotation encloses an angle of 45° with the horizon and the at least one people carrier is rotatable relative to the at least one arm on an oblique axis which encloses an angle of 45° with the at least one arm.

9. Fairground attraction as claimed in claim 1, wherein the at least one arm is mounted in the bearing at a point intermediate along a length of the at least one arm.

10. Fairground attraction, comprising:

an upright frame;

at least one arm which is mounted for rotation perpendicularly about a longitudinal axis of the at least one arm in a bearing arranged in a top of the frame, said top being pivotable relative to a remaining part of the frame;

at least one people carrier suspended on an end of the least one arm that is spaced from the rotation axis;

a drive device that rotatingly drives the at least one arm;

a displacing device arranged between the top of the frame supporting the bearing and the remaining part of the frame, which displacing device comprises a drive for causing pivoting of the top of the frame; and a movable locking pin that rigidly connects the top of the frame and the remaining part of the frame to each other so as to block the displacing device during operation of the fairground attraction, wherein the displacing device is arranged to displace the at least one people carrier in height direction in a rest position of the at least one arm.

11. Fairground attraction as claimed in claim 10, wherein the top of the frame is pivotable about a lying axis which lies substantially transversely of the rotation axis of the at least one arm.

12. Fairground attraction as claimed in claim 11, wherein the drive comprises two hydraulic jacks arranged on either side of the bearing, one end of each hydraulic jack being connected to the top of the frame and the other end to the remaining part of the frame.

13. Fairground attraction as claimed in claim 12, wherein when the two hydraulic jacks are fully extended the top of the frame pivots so that the arm comes to lie along the remaining part of the frame.

14. Fairground attraction as claimed in claim 11, wherein the drive device of the arm are accommodated in the pivotable top of the frame.

15. Fairground attraction as claimed in claim 10, wherein during operation of the fairground attraction the axis of rotation encloses an angle of 45° with the horizon and the at least one people carrier is rotatable relative to the at least one arm on an oblique axis which encloses an angle of 45° with the at least one arm.

16. Fairground attraction as claimed in claim 10, wherein the at least one arm is mounted in the bearing at a point intermediate along a length of the at least one arm.

* * * * *